US008311427B2

(12) United States Patent
Mitsunobu

(10) Patent No.: US 8,311,427 B2
(45) Date of Patent: Nov. 13, 2012

(54) IMAGE FORMING DEVICE AND METHOD

(75) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 277 days.

(21) Appl. No.: 12/801,407

(22) Filed: Jun. 8, 2010

(65) Prior Publication Data

US 2010/0322649 A1 Dec. 23, 2010

(30) Foreign Application Priority Data

Jun. 22, 2009 (JP) ..... 2009-147368

(51) Int. Cl.
*G03G 15/00* (2006.01)

(52) U.S. Cl. ..... 399/49; 399/55

(58) Field of Classification Search ..... 399/49, 399/53, 55, 56

See application file for complete search history.

(56) References Cited

U.S. PATENT DOCUMENTS 6,415,114 B1 * 7/2002 Nakazato et al. ..... 399/49
2004/0165899 A1 * 8/2004 Chigira ..... 399/49

FOREIGN PATENT DOCUMENTS

JP A-2004-341100 12/2004
JP A-2007-298793 11/2007
JP A-2007-304360 11/2007

* cited by examiner

*Primary Examiner* — Hoang Ngo
(74) *Attorney, Agent, or Firm* — Posz Law Group, PLC

(57) ABSTRACT

An image forming device and method improves image quality by detecting the density of a pattern and adjusting the voltage applied to a developer supply member if necessary in response to the detected density. The pattern can be a medium duty tone pattern, which is relatively sensitive to environmental changes that can affect image density. The density detection pattern can be produced and detected after every predetermined number of sheets are printed, to maintain an acceptable image density during large print jobs. The pattern is formed on the surface of a transferring unit, which transfers the sheets.

14 Claims, 8 Drawing Sheets

IMAGE FORMING DEVICE AND METHOD

CROSS REFERENCE

The present application is related to, claims priority from and incorporates by reference Japanese patent application number 2009-147368, filed on Jun. 22, 2009.

TECHNICAL FIELD

The present application relates to an image forming device and method, and more particularly to an image forming device and method for adjusting the density of images.

BACKGROUND

Conventionally, an image forming device, such as a printer, a copier, a facsimile machine and a multifunction machine, for example a color printer, has image forming units of colors of black, yellow, magenta and cyan. A photoreceptor drum is charged by a charge roller at each of the image forming units, a latent image is formed by a light emitting diode (LED) head exposing the photoreceptor drum, and a toner image of each color is formed by electrostatically adhering toner that is a developer on a developing roller. The toner is formed in a thin-layered manner on the developing roller for the latent image.

Then, each toner image is transferred onto a carried sheet in order by a transferring roller in accordance with a transferring belt running along with each image forming unit, and each of the color toner images are formed. Subsequently, the sheet is sent to a fuser, the color toner images are fused on the sheet at the fuser. The color image is formed.

With this kind of printer, it is necessary to detect the density of the toner image of each color in order to adjust the color image. In order to do so, the predetermined shaped image is formed as a density detecting pattern on the transferring belt by the toner of each color. Subsequently, the density of image part of each color that structures the density detecting pattern is detected, and the voltage that is applied to the developing roller, in other words, the developing voltage is corrected based on the detected density. Accordingly, density of each toner image can be corrected and the color image can be adjusted. (for example, see Japanese laid-open patent application number 2004-341100)

However, with the conventional printer, for example, when the toner is overly charged due to the temperature and moisture around the printer or the like, the density of the toner image of each color becomes high beyond the density range. As a result, the density of each toner image cannot be corrected by only correcting the developing voltage. The color image cannot be adjusted sufficiently; therefore, the image quality decreases.

The present application shows an image forming device that can solve the problems of the conventional printers, and can improve image quality even when the developer is overly charged due to the environmental changes.

SUMMARY

For the purpose, an image forming device of the present application includes an image carrier; an exposure device that forms a latent image on a surface of the image carrier; a developer carrier that develops the latent image and forms a developer image by attaching developer on the image carrier; a developer supplying member that supplies the developer to the developer carrier; a transferring member that transfers the developer image on a medium; a pattern forming processing part that forms a predetermined density detecting pattern on a pattern forming medium; a density detection processing part that detects a density of the density detecting pattern on the pattern forming medium; and a supply voltage changing processing part that changes a supply voltage that is applied to the developer supplying member.

In another view of the embodiment, an image forming method of the present application includes forming a latent image on a surface of an image carrier; developing the latent image and forming a developed image by attaching developer on the image carrier; supplying the developer to a developer carrier with a developer supplying member; transferring the developer image to a sheet, which is carried by a transferring unit; forming a predetermined density detecting pattern on a surface of the transferring unit; detecting a density of the density detecting pattern; and changing a supply voltage that is applied to the developer supplying member if the detected density is outside of a predetermined range.

With such a structure, a density detecting pattern formed with the developer is formed on the predetermined pattern forming medium, the density of the density detecting pattern is detected, and the supply voltage is changed based on the detected density. Accordingly, even when the developer is overly charged due to the environmental changes, the high image quality is maintained. In other words, the image quality is improved compared with the quality by the conventional devices.

DETAILED DESCRIPTION OF THE EMBODIMENTS

Figure 1:
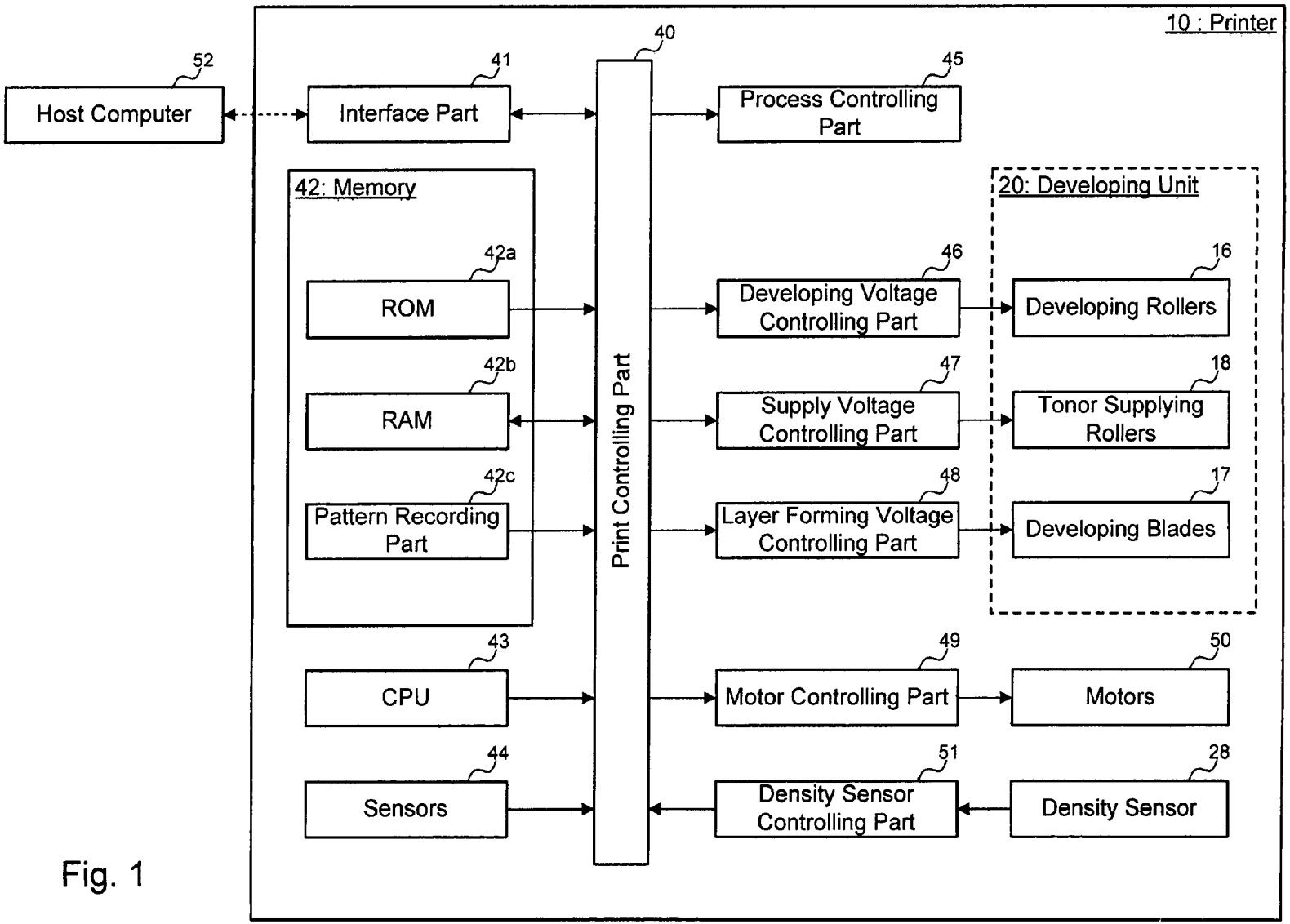
FIG. 1 illustrates a control block diagram of a printer of a first embodiment.

Hereafter, the embodiments of the present application are explained in detail referring to the drawings. In this case, a color printer as an image forming device is explained.

Figure 2:
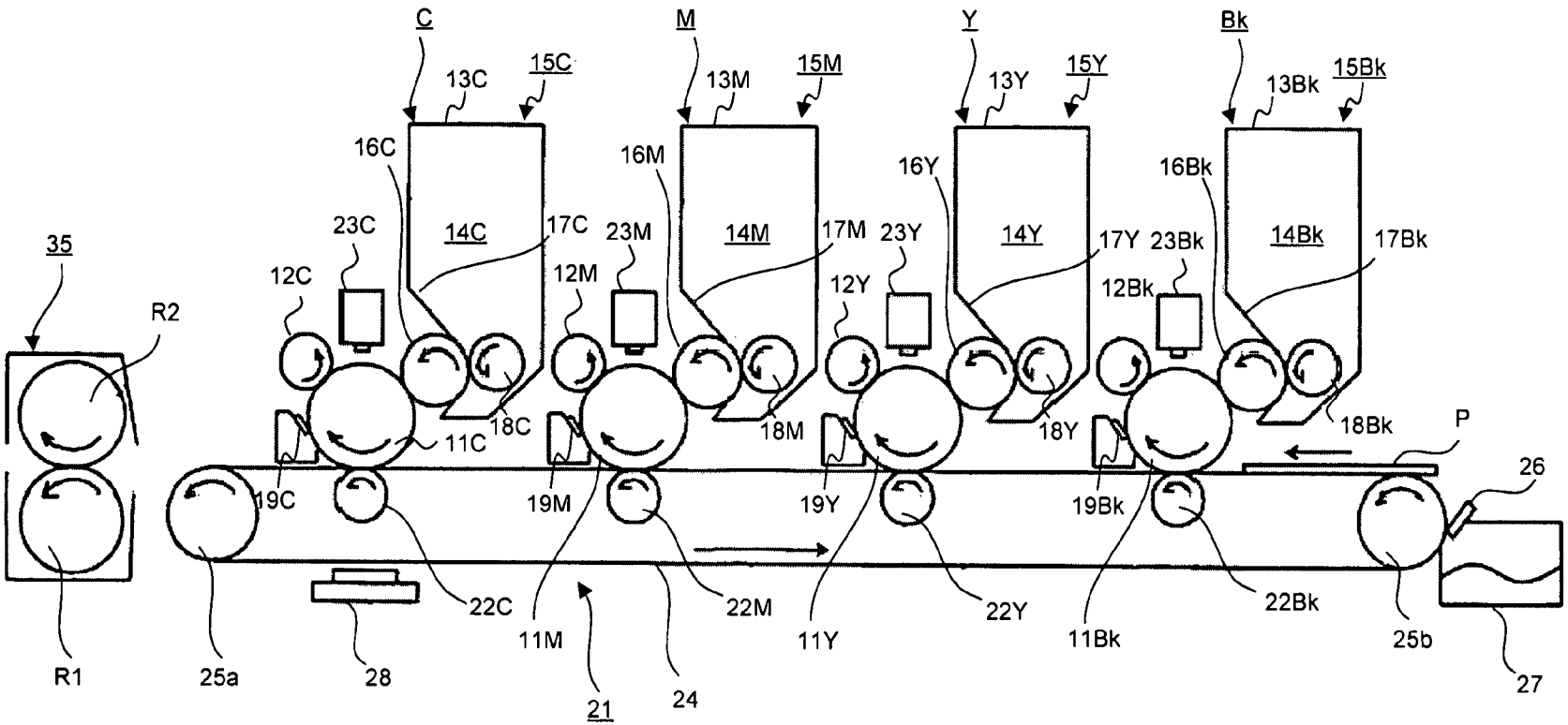
FIG. 2 illustrates a schematic diagram of the printer of the first embodiment.

FIG. 2 illustrates a schematic diagram of a printer of the first embodiment.

As shown in the figures, image forming parts Bk, Y, M and C for each of four colors of toners 14 (black, yellow, magenta and cyan) serve as a developer in the printer. LED heads 23, serve as exposing devices that correspond to each of the image forming part Bk, Y, M and C. A transferring unit 21 is located below the image forming parts Bk, Y, M and C. Since the structures of each of the image forming parts Bk, Y, M and C are basically the same, only the image forming part Bk is explained.

The image forming part Bk includes an image forming unit 15Bk for forming black toner images. The image forming unit

15Bk includes a photoreceptor drum 11, or image carrier, which uses an organic photoreceptor on its surface. Around the photoreceptor drum 11Bk are a charge roller 12Bk, or charge device, a developing roller 16Bk, or developer carrier, and a cleaning blade 19Bk, or cleaning member, which are arranged to contact the photoreceptor drum 11Bk. On the image forming unit 15Bk are a toner supplying roller 18Bk and a developing blade 17Bk, which are arranged to contact the developing roller 16Bk. The toner supplying roller 18Bk charges the toner 14Bk that is supplied from the toner cartridge 13Bk, or developer cartridge, and supplies the toner 14Bk to the developing roller 16Bk, or developer supplying member. The developing blade 17Bk, which serves as a developer layer restricting member, forms a thin layer of the toner 14Bk (namely a toner layer) that is supplied from the toner supplying roller 18Bk, is arranged to contact the developing roller 16. The developing blade 17 is arranged to press and contact the developing roller 16Bk at the downstream side of the toner supplying roller 18Bk considering the rotating direction of the developing roller 16Bk. In the present embodiment, negative conductivity toner is used for the toner 14Bk, and the average grain diameter of the pulverized shape is 8 μm by using a pulverization method. The toner 14Bk is formed from polyester resin, coloring agent, charge controlling agent and release agent, and an additive agent (hydrophobic silica) is included.

The transferring unit 21 provides drive rollers 25*a* and 25*b*, which serve as first and second carrying parts, a transferring belt 24, which is movably provided in a tensioned state between the drive rollers 25*a* and 25*b* and is arranged to contact each of the photoreceptor drums 11, and a transferring roller 22, which serves as a transferring member that is opposed to each of the photoreceptor drums 11 through the transferring belt 24.

Then, a cleaning blade 26, or cleaning member, is arranged to scrape the toner 14 that is attached on the transferring belt 24, and the toner 14 that is scraped by the cleaning blade 26 is collected as waste toner in a waste toner box 27. A density sensor 28, or density detecting part, which is configured with a light emitting part and a light receiving part, is; located downstream of a drive roller 25*a* in a running direction of the transferring belt 24.

Then, at the downstream side of the image forming unit C in the carrying direction of sheet P, or medium, a fuser 35, or fusing device, which includes first and second fusing rollers R1 and R2.

With the printer discussed above, at the image forming units 15Bk, 15Y, 15M and 15C (hereinafter referred to as image forming units 15), photoreceptor drums 11Bk, 11Y, 11M, and 11C (photoreceptor drums 11) are charged by the charge rollers 12Bk, 12Y, 12M, and 12C (charge rollers 12). Electrostatic latent images are formed by the LED heads 23Bk, 23Y, 23M, and 23C (LED heads 23). The thin layered toners 14Bk, 14Y, 14M, and 14C (toner 14) on the developing rollers 16Bk, 16Y, 16M, and 16C (developing rollers 16) are statically adhered to the electrostatic latent image so that toner images of different colors are formed.

Subsequently, the toner image of each color is transferred to a sheet P in order by the transferring rollers 22. The sheet P is carried along with the running transferring belt 24 so that a four color toner image is formed. The sheet P is sent to the fuser 35, and at the fuser 35, the color toner image is fused on the sheet P to complete the color image.

Next, a controller of the afore-mentioned printer is explained.

FIG. 1 illustrates a control block diagram of a printer of a first embodiment.

In the figure, 10 designates a printer, and 40 designates a print controlling part, or a first controller. The print controlling part 40 entirely controls the printer 10. In the print controlling part 40, an interface part 41, which receives print data from a host computer 52, or host device, a memory 42, or memory device, a CPU 43, which performs a density correction calculation and serves as a second controller, and various kinds of sensors 44, such as a sensor, or medium detecting part, that detects the sheet P (FIG. 2) are connected. The memory 42 includes a ROM 42*a*, or first memory part, a RAM 42*b*, or second memory part, and a pattern recording part 42*c*, or third memory part, in which a later-mentioned density detecting pattern is recorded.

In the print controlling part 40, a process controlling part 45, or third controller, a developing voltage controlling part 46, or fourth controlling part, a supply voltage controlling part 47, or fifth controller, a layer forming voltage controlling part 48, or sixth controller, a motor controlling part 49, or seventh controlling part, and a density sensor controlling part 51 are connected. The process controlling part 45 controls a charge voltage that is applied to the charge roller 12, a head drive voltage applied to the LED heads 23, a transfer voltage applied to the transferring rollers 22, and the other voltages. The developing voltage controlling part 46 controls the developing voltage that is applied to the developing rollers 16. The supply voltage controlling part 47 controls the supply voltage that is applied to toner supplying rollers 18Bk, 18Y, 18M, and 18C (toner supplying rollers 18). The layer forming voltage controlling part 48 controls the layer forming voltage that is applied to developing blades 17Bk, 17Y, 17M, and 17C (as developing blades 17). Moreover, a developing unit 20 is configured with the developing rollers 16, the developing blades 17 and toner supplying rollers 18.

Each of the motors 50, or driving parts, is driven by the motor controlling part 49 to rotate the drive rollers 25*a*, 25*b* or the like of the developing rollers 16, toner supplying rollers 18, photoreceptor drums 11, the charge rollers 12, transferring rollers 22Bk, 22Y, 22M, and 22C (transferring rollers 22) and the transferring belt 24. The sensor output of the density sensor 28 is read by the density sensor controlling part 51.

Next, the print operation of the printer 10 of the aforementioned structure is explained.

Figure 3:
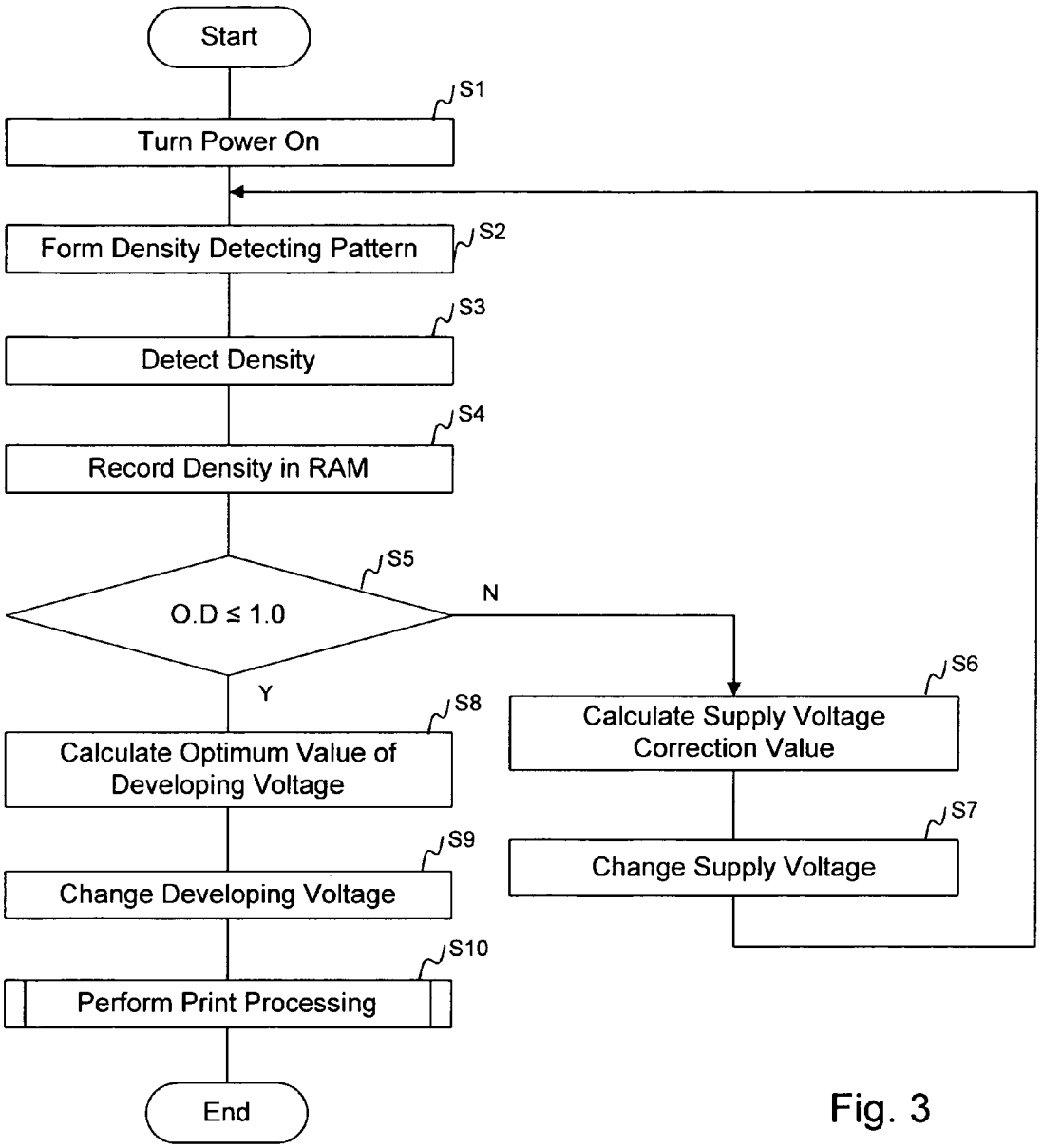
FIG. 3 illustrates a flow diagram showing print operation of the printer of the first embodiment.
Figure 4:
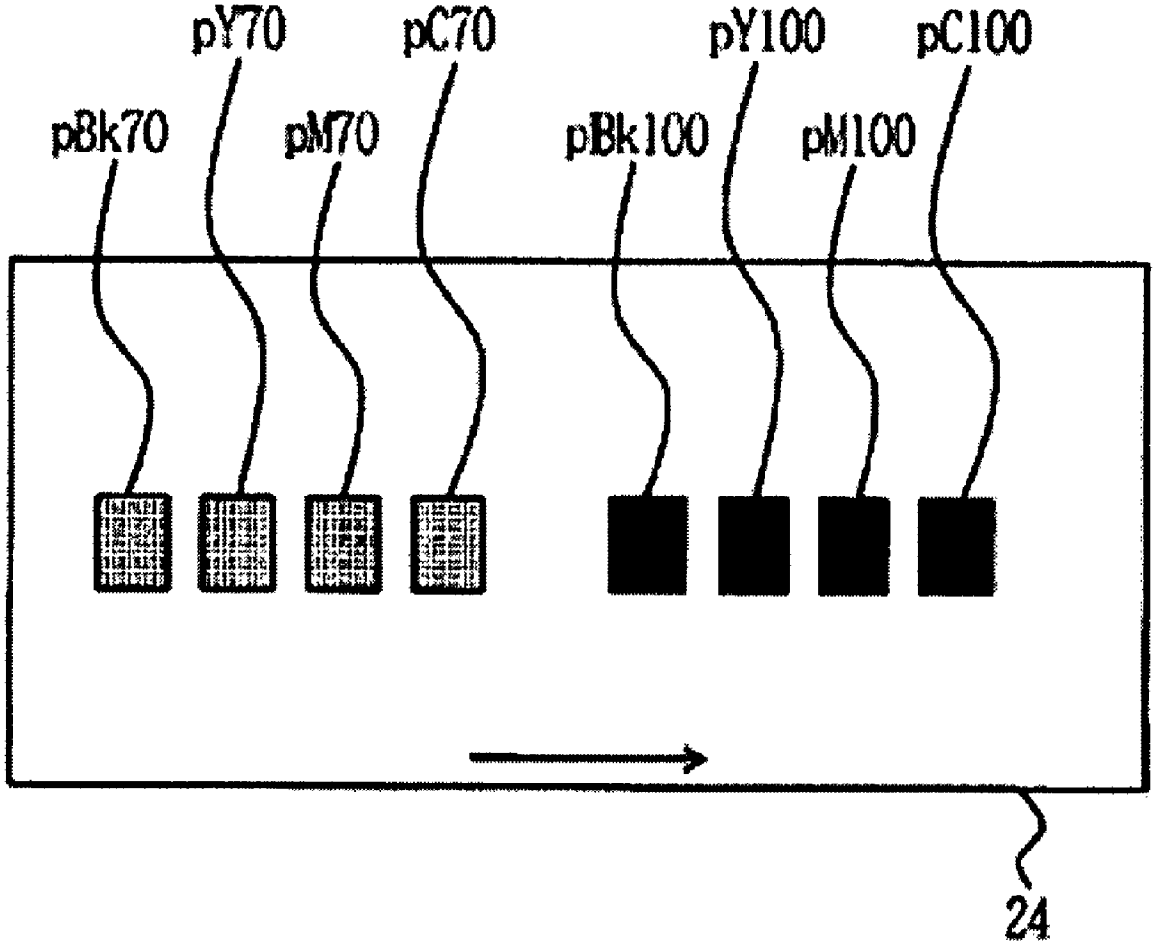
FIG. 4 illustrates a density detecting pattern on a transferring belt of the first embodiment.

FIG. 3 illustrates a flow diagram showing print operation of a printer of the first embodiment and FIG. 4 illustrates a density detecting pattern on the transferring belt 24 of the first embodiment.

First, when the power of the printer 10 is turned on initially, a drive processing part of the print controlling part 40, which is not shown in the figures, performs drive processing, and drives each of motors 50 by the motor controlling part 49. A voltage application processing part of the print controlling part 40, which is not shown in the figures, performs voltage application processing. In the processing, the voltage application processing part reads the setting values (bias setting) of the developing voltage, the supply voltage, the layer forming voltage or the like from ROM 42*a*. The developing voltage controlling part 46 applies a developing voltage of −200[V] to the developing rollers 16. The supply voltage controlling part 47 applies a supply voltage of −300[V] to the toner supplying rollers 18. The layer forming voltage controlling part 48 applies a layer forming voltage of −300[V] to the developing blades 17. The process controlling part 45 applies the charge voltage of −1000[V] to the charge rollers 12. Accordingly, the surface of the photoreceptor drum 11 is uniformly charged, and the transfer voltage of +4000 [V] is applied to the transferring rollers 22.

Incidentally, with the printer 10 of the aforementioned structure, it is necessary to detect the density of toner images of each color in order to adjust the color image. Therefore, images of predetermined shapes are formed as a density detecting pattern by each color of the toners 14 (14Bk, 14Y, 14M, and 14C) on the transferring belt 24. Then, the density of each color pattern that forms the density detecting pattern is detected, and the developing voltage is corrected based on the detected density. Accordingly, the density of each toner image can be corrected and color image can be adjusted.

However, for example, when the toners 14 are overly charged by environmental changes such as the temperature and humidity around the printer 10, and the density of the toner image of each color becomes high beyond the predicted density range, the density of each toner image cannot be corrected sufficiently by only correcting the developing voltage, the color image cannot be adjusted sufficiently, and the image quality deteriorates.

Therefore, as for the present application, the supply voltage and the developing voltage are corrected based on the density of the pattern of each color.

Because of this, the pattern forming processing part 40, which is not shown in the figures, performs pattern forming processing, drives each of the LED heads 23 by the process controlling part 45, reads the density detecting pattern from the pattern recording part 42*c*, exposes the photoreceptor drum 11 by irradiating light that corresponds to the image data that forms the density detecting pattern on each of the photoreceptor drums 11, and forms the electrostatic latent image of the pattern in each color. Accordingly, the electrostatic latent image is developed by each of the developing rollers 16, the toner images of patterns in each color are formed, and the patterns for detecting density are formed at predetermined places on the running transferring belt 24 by each of the transferring rollers 22 as shown in FIG. 4. The transferring belt 24 functions as a pattern forming medium that forms the density detecting pattern.

Then, a black pattern pBK, a yellow pattern pY, a magenta pattern pM and a cyan pattern pC are formed as the patterns in each color. In this case, the density detecting pattern is formed in two duty types, a high tone duty and middle tone duty. In the present application, the high tone duty (or 100% duty), or first pattern, is formed from each color to form patterns pBK100, pY100, pM100 and pC100. The middle tone duty (or 70% duty), or second pattern, is formed from each color to form patterns pBK70, pY70, pM70 and pC70. Herein, the density detecting pattern includes image data for forming the developer with a predetermined area ratio on a two dimensional plan region under a standard print environment. The term "duty" refers to a developer formed area ratio where the developer is formed on the plan region using the image data of the density detecting pattern. A 100% duty of the density detecting pattern means that the developer is formed with 100% area ratio of developer (or covers all the plan region) and with 0% area ratio of non-developer on the plan region of the density detecting pattern. A 70% duty of the density detecting pattern means that the developer is formed with 70% area ratio of developer and with 30% area ratio of non-developer.

Next, the density detecting processing part of the print controlling part 40 (not illustrated) performs density detection processing, reads the sensor output of the density sensor 28, detects the densities pBk100*a*, pY100*a*, pM100*a*, pC100*a*, pBk70*a*, pY70*a*, pM70*a* and pC70*a* of the patterns pBk100, pY100, pM100, pC100, pBk70, pY70, pM70 and pC70, respectively, and records an optical density value (hereafter O.D. value) of the densities pBk100*a*, pY100*a*, pM100*a*, pC100*a*, pBk70*a*, pY70*a*, pM70*a* and pC70*a* into the RAM 42*b*.

However, when the toner 14 is overly charged, and the potential vt of the toner layer (toner layer potential) on the development roller 16 becomes negatively greater, a dot becomes large, and the densities pBk70*a*, pY70*a*, pM70*a* and pC70*a* also become high. In this case, the densities pBk70*a*, pY70*a*, pM70*a* and pC70*a* become unstable, and their tones become low, causing the image quality to deteriorate.

Therefore, in the present application, when the densities pBk70*a*, pY70*a*, pM70*a* and pC70*a* become high, the supply voltage is changed so that the toner 14 is adequately charged.

For such a purpose, a correct voltage calculation processing part of the CPU 43 (not illustrated) performs correct voltage calculation processing, reads the O.D. value of the densities pBk70*a*, pY70*a*, pM70*a* and pC70*a*, and calculates the correct voltage, in other words, the supply voltage correction value, in order to change the supply voltage. The correct voltage is preset in corresponding to each of the O.D. values.

Since the patterns pBk70, pY70, pM70 and pC70 that are formed with 70% duty are relatively more sensitive to the environmental changes, the densities pBk70*a*, pY70*a*, pM70*a* and pC70*a* easily change when environment conditions change. This makes it easier to judge whether or not the density is stable. Therefore, in the present application, the supply voltage correction value is calculated based on the densities pBk70*a*, pY70*a*, pM70*a* and pC70*a*.

For the middle tone duty, the patterns pBk70, pY70, pM70 and pC70 are formed with 70% duty; however, it is also practical to form the patterns with a duty of equal to or more than 30% and with a duty of equal to or less than 80% duty for the middle tone duty.

Table 1 shows the relationship between the O.D. value, which represents the densities pBk70*a*, pY70*a*, pM70*a* and pC70*a*, and the supply voltage correction value.

TABLE 1

| Potential of Toner Layer [V] | $-60 \leqq vt$ | $-90 < vt < -60$ | $Vt \leqq -90$ |
|---|---|---|---|
| O.D. Value | $O.D. \leqq 1.0$ | $1.0 < O.D. < 1.3$ | $1.3 \leqq O.D.$ |
| Supply Voltage Correction Value [V] | 0 | 20 | 40 |

In this case, each O.D. value is shown corresponding to the potential vt of the toner layer on the developing roller 16. The supply voltage correction value is the value to adequately charge the toner 14 and is the correction value to correct each O.D. value.

For example, when the potential vt of the toner layer is $-60[V] \leqq vt$, the toner 14 is adequately charged, the O.D. value becomes $O.D. \leqq 1.0$ and is stabilized, and the supply voltage correction value is set as +0 [V].

When the potential vt of the toner layer is $-90[V] < vt < -60$ [V], the toner 14 is overly charged, the O.D. value becomes $1.0 < O.D. < 1.3$ and becomes unstable, and the supply voltage correction value is set as +20 [V].

Then, when the potential vt is $vt \leqq -90[V]$, the toner 14 is further overly charged, the O.D. value becomes $1.3 \leqq O.D.$ and becomes more unstable, and the supply voltage correction value is set as +40 [V].

Therefore, the O.D. value of the densities pBk70*a*, pY70*a*, pM70*a* and pC70*a* and the supply voltage correction value are recorded in the ROM 42*a* in correspondence. The correct voltage calculation processing part judges whether or not the O.D. value is equal to or less than 1.0 when reading the O.D.

value. When the O.D. value is equal to or less than 1.0, the supply voltage correction value that corresponds to the O.D. value is calculated by reading from the ROM42*a*, and recorded in the RAM 42*b*. In this case, the voltage applied to the photoreceptor drums 11 is constant, and the layer forming voltage is made to be equal to the supply voltage.

Subsequently, the supply voltage change processing part (not illustrated) in the CPU43 performs the supply voltage change processing, reads the supply voltage correction value from the RAM 42*b*, changes the supply voltage based on the supply voltage correction value, and records the changed supply voltage into the RAM 42*b*. In the present application, the supply voltage correction value is added to a standard supply voltage. For example, when the supply voltage correction value is +20 [V], since the standard voltage is −300 [V], the supply voltage after the change is −280 [V],

−300 [V]+20 [V]=−280 [V].

Then, the density detecting pattern is formed according to the supply voltage after the change, and the calculation of the supply voltage by the supply voltage correction value is repeated until the O.D. value becomes a normal value of equal to or less than 1.0. In the present application, the calculation is repeated until the O.D. value becomes 1.0. When the O.D. value becomes 1.0, the developing voltage corresponds to the supply voltage.

In this case, when the O.D. value of the densities pBk70*a*, pY70*a*, pM70*a* and pC70*a* is approximately 1.0, the tone can be stabilized (stable). The O.D. value of the densities pBk70*a*, pY70*a*, pM70*a* and pC70*a* is defined as densities at the time of when the patterns pBk70, pY70, pM70 and pC70 are formed with 70% of duty Therefore, the developing voltage change processing part of the voltage apply processing part performs developing voltage change processing, calculates a optimum value of the developing voltage based on the O.D. value of the densities pBk100*a*, pY100*a*, pM100*a* and pC100*a*, changes the developing voltage to the optimum value, and records it to the RAM 42*b*.

In this case, it is defined that the control target value is Tod (Tod=1.5), the optimum value of the developing voltage is Vdk, and a coefficient that is a change ratio of the developing voltage at the time of the supply voltage changed is k (k=0.003). Herein, the control target value is a target of the O.D. value of the densities pBk100*a*, pY100*a*, pM100*a* and pC100*a*. Since the standard developing voltage is −200 [V], the optimum value Vdk is calculated by performing linear interpolation:

$$Vdk = -200 + (O.D. - Tod)/k)[V]$$

$$= -200 + (O.D. - 1.5)/0.003)[V]$$

For example, when the O.D. value is 1.6, the optimum value Vdk is −167 [V] (Vdk=−167 [V]).

The supply voltage change processing part calculates the optimum value Vsk and records it on the RAM 42*b*. When the supply voltage correction value is +20 [V], the difference between the supply voltage and the developing voltage is:

−200 [V]−(−300 [V]+20 [V])=+80 [V]).

Therefore, it becomes −247 [V] (Vsk=Vdk−80 [V]=−247 [V]).

Accordingly, when the O.D. value of the densities pBk70*a*, pY70*a*, pM70*a* and pC70*a* is 1.0, and the O.D value of the densities pBk100*a*, pY100*a*, pM100*a* and pC100*a* is 1.5, the supply voltage can be the optimum value Vsk, and the developing voltage can be the optimum value Vdk.

Then, the print processing part of the print controlling part 40 (not shown) applies the developing voltage of the optimum value Vdk to the developing roller 16 and applies the supply voltage of the optimum value Vsk to the supply roller 18 by performing print processing.

Accordingly, even when the toner 14 is overly charged due to the environmental changes, the tone can be high, and image quality can be improved.

Since the O.D. value is read based on the density detecting pattern, and the supply voltage becomes the optimum value Vsk based on the O.D. value, the densities of pBk100*a*, pY100*a*, pM100*a*, pC100*a*, and the densities of pBk70*a*, pY70*a*, pM70*a* and pC70*a* can be stabilized. As a result, the tone is higher, and the image quality is improved.

Next, flow diagrams are explained. At S1, a power is tuned on. At S2, the density detecting pattern is formed. At S3, the density sensor 28 detects the densities of pBk100*a*, pY100*a*, pM100*a*, pC100*a*, pBk70*a*, pY70*a*, pM70*a* and pC70*a*. At S4, the densities pBk100*a*, pY100*a*, pM100*a*, pC100*a*, pBk70*a*, pY70*a*, pM70*a* and pC70*a* are recorded in the RAM 42*b*. At S5, the processing judges whether or not the O.D. value is equal to or less than 1.0. When the O.D. value is equal to or less than 1.0 (Yes), the processing proceeds to S8. When the O.D. value is greater than 1.0 (No), the processing proceeds to S6. At S6, the supply voltage correction value is calculated. At S7, the supply voltage is changed, and returns to S2. At S8, the optimum value of the developing voltage is calculated. At S9, the developing voltage is changed. At S10, performs the print processing and ends the processing.

Subsequently, the second embodiment of the present application is explained. The same numbers are used for parts that have the same structure as the first embodiment. The effects of the second embodiment that derive from the structure of the first embodiment are the same as those of the first embodiment.

Figure 5:
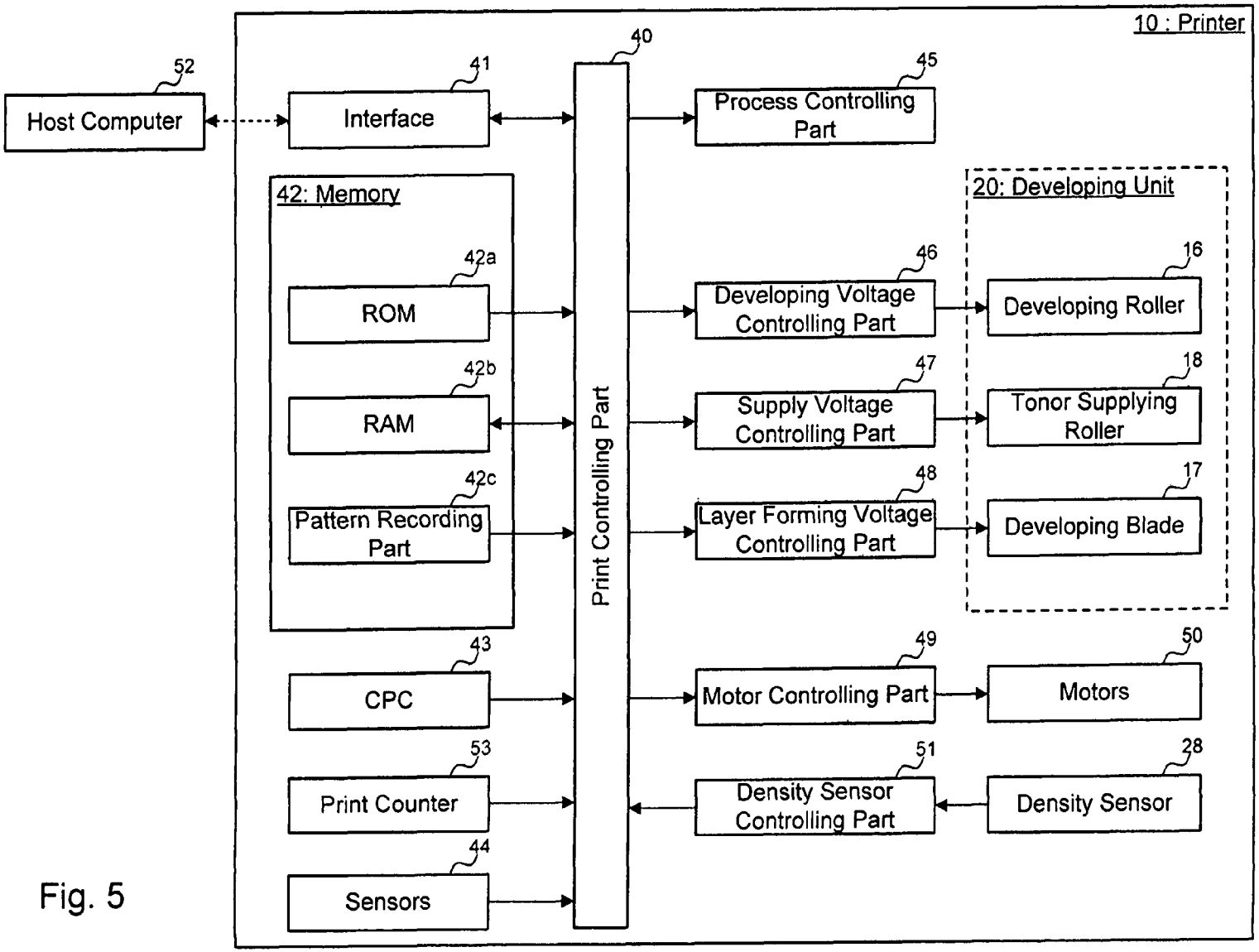
FIG. 5 illustrates a control block diagram of the printer of a second embodiment.

FIG. 5 illustrates a control block diagram of a printer of the second embodiment.

In the figure, 53 is a print counter that counts the number of print sheets (or the amount of print sheets), and the print counter 53 counts the number of print sheet as print index that shows cumulative printing amount, and sends the count value to the print controlling part 40 as the first controller. The print counter 53 increments the count number every time that the print operation is performed per sheet of the sheet P of a lateral feeding of an A4 size sheet (see FIG. 2).

Next, the print operation of the printer 10 of the aforementioned structure is explained.

Figure 6:
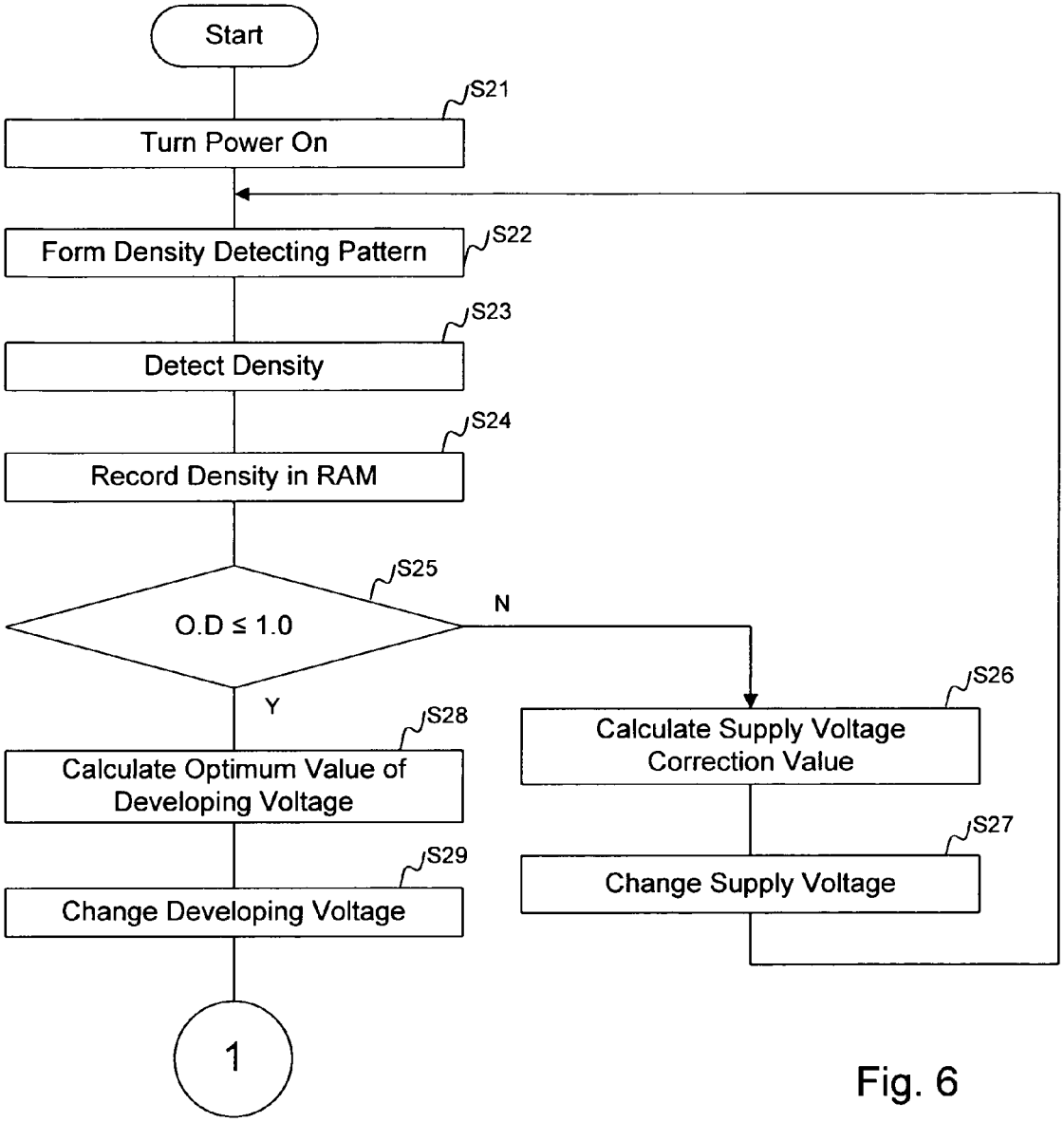
FIG. 6 illustrates a first flow diagram showing print operation of the printer of the second embodiment.
Figure 7:
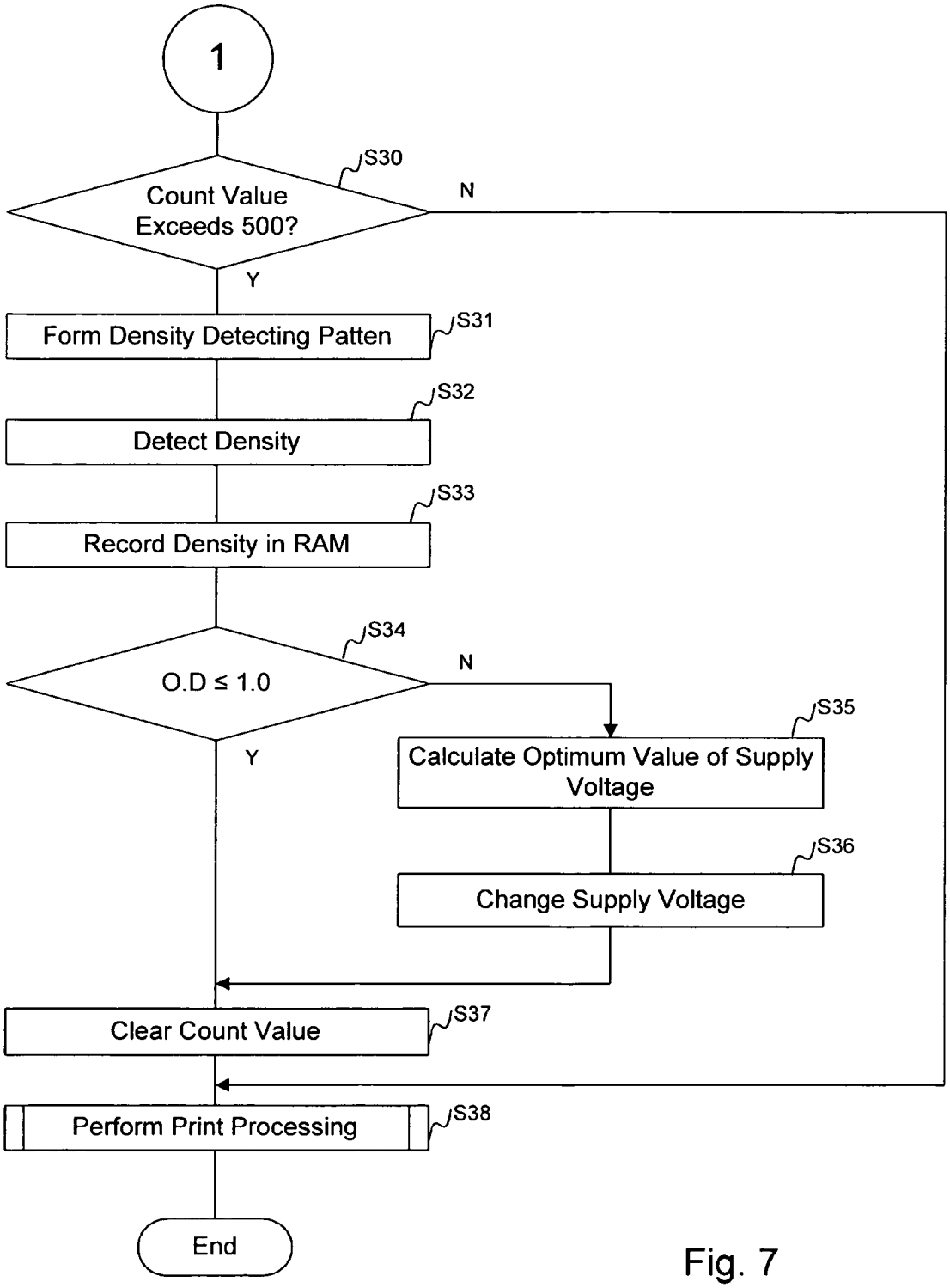
FIG. 7 illustrates a second flow diagram showing the print operation of the printer of the second embodiment.
Figure 8:
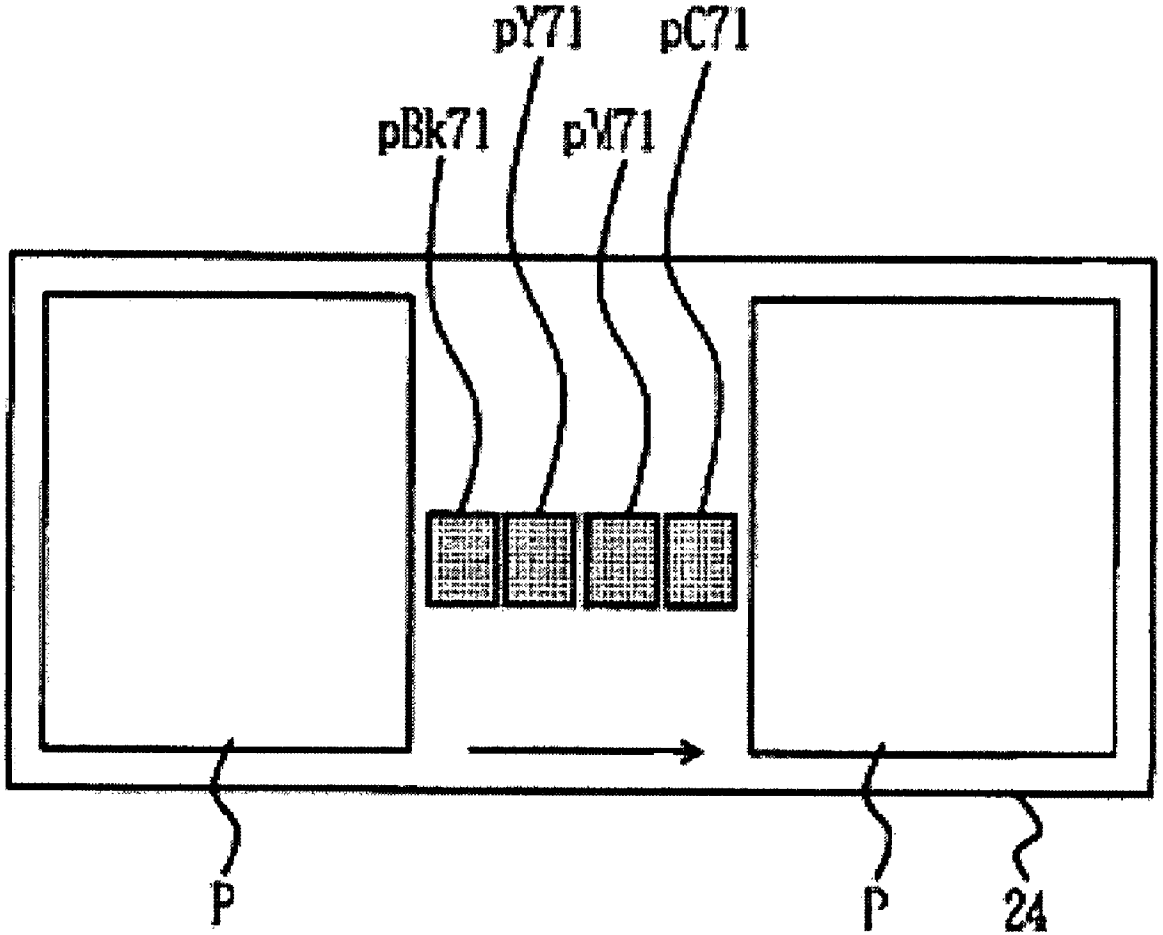
FIG. 8 illustrates a density detecting pattern on a transferring belt of the second embodiment.

FIG. 6 illustrates a first flow diagram showing print operation of the printer of the second embodiment. FIG. 7 illustrates a second flow diagram showing print operation of the printer of the second embodiment. FIG. 8 illustrates a density detecting pattern on a transferring belt of the second embodiment.

When the power of the printer 10 is turned on initially, as in the first embodiment, the pattern forming processing part of the print controlling part 40 forms the density detecting pattern as shown in FIG. 8.

The density detecting patterns are formed from two types: the first pattern of each color (pBK100, pY100, pM100 and pC100) is formed with 100% duty, and the second pattern of each color (pBK70, pY70, pM70 and pC70) is formed with 70% of duty.

First, the density detection processing part detects the densities pBk100*a*, pY100*a*, pM100*a*, pC100*a*, pBk70*a*, pY70*a*, pM70*a* and pC70*a* of the patterns pBk100, pY100, pM100, pC100, pBk70, pY70, pM70 and pC70, and memorizes the O.D. value of the densities pBk100*a*, pY100*a*, pM100*a*, pC100*a*, pBk70*a*, pY70*a*, pM70*a* and pC70*a* in the RAM 42*b*.

Subsequently, the correct voltage calculation processing part of the CPU 43, which serves as a calculation device and as the second controlling part, reads each of the O.D. values, and calculates the correct voltage, in other words, the supply voltage correction value, in order to change the supply voltage that is preset in correspondence to each of the O.D. values.

Next, the correct voltage calculation processing part of the CPU 43 reads the supply voltage correction value from the RAM 42*b*, changes the supply voltage based on the supply voltage correction value, and records the supply voltage in the RAM 42*b*.

Then, the density detecting pattern is formed again by the newly corrected supply voltage. The calculation of the supply voltage by the supply voltage correction value is repeated until the O.D. value becomes a normal value, which is equal to or less than 1.0. In the present application, the calculation is repeated until the O.D. value becomes 1.0. When the O.D. value is 1.0, the developing voltage is changed in corresponding to the supply voltage.

Therefore, the developing voltage change processing part of the voltage apply processing part calculates the optimum value Vdk based on the O.D. value of the densities of pBk100*a*, pY100*a*, pM100*a* and pC100*a*, changes the developing voltage to the optimum value Vdk, and records it in the RAM 42*b*.

The voltage change processing part calculates the optimum value Vsk of the supply voltage, changes the supply voltage to the optimum voltage Vsk, and records it in the RAM 42*b*.

Accordingly, when the O.D. value of the densities pBk70*a*, pY70*a*, pM70*a* and Pc70*a* become 1.0, and when the densities pBk100*a*, pY100*a*, pM100*a* and pC100*a* become 1.5, the supply voltage can be the optimum value Vsk, and the developing voltage can be the optimum value Vdk.

Subsequently, the print processing part of the print controlling part 40 performs the printing operation by applying the optimum value Vdk of the developing voltage to the developing rollers 16 as the developer carrier, and by applying the optimum value Vsk of the supply voltage to the toner supplying rollers 18 as the developer supplying member.

Accordingly, while the printing operation is being repeated, the print counter 53 counts the print sheets, sends the count value to the print controlling part 40, and the print controlling part 40 records the count value in the RAM 42*b*.

Consequently, the print amount judging processing part reads the count value and judges whether the count value exceeds 500 that is a threshold by performing print amount judging processing.

Then, when the count value exceeds 500 that is the threshold value of the count value, the pattern forming processing part of the print controlling part 40, as shown in FIG. 8, forms the density detecting pattern between sheets P on the transferring belt 24 as a belt member. In other words, the density detecting pattern is formed on an area of the transferring belt that does not correspond to an area occupied by a sheet, or medium, on which images are being formed.

In this case, the density detecting pattern is configured with patterns of each color pBk71, Py71, pM1 and pC71 that are formed with 70% duty.

Next, the density detecting processing part of the print controlling part 40 detects the densities pBk71*a*, pY71*a*, pM71*a* and pC71*a* of the patterns pBk71, pY71, pM1 and pC71, and records the O.D. value of the densities pBk71*a*, pY71*a*, pM71*a* and pC71*a* in the RAM 42*b*.

Subsequently, the correct voltage calculation processing part of the CPU 43 reads each of the O.D. values, calculates the supply voltage correction value that is predetermined as in the first embodiment in correspondence with each of the O.D. values and records it in the RAM 42*b*.

Next, the supply voltage change processing part of the CPU 43 reads the supply voltage correction value from the RAM 42*a*, changes the supply voltage based on the supply voltage correction value, and records it in the RAM 42*b*.

Then, the density detecting pattern is formed by the supply voltage that has been changed, and the calculation of the supply voltage by the supply voltage correction value is repeated until the O.D. value becomes normal value, which is equal to or less than 1.0. In the present application, the calculation is repeated until the O.D. value becomes 1.0. When the O.D. value is 1.0, the supply voltage change processing part clears the count value, and the print processing part of the print controlling part 40 prints the printing operation by applying the changed supply voltage to the toner supplying roller 18.

In the present embodiment, every time the count value exceeds 500 and the number of the print sheets exceeds 500, the density detecting pattern is formed between sheets P, and the densities pBk71*a*, pY71*a*, pM71*a* and pC71*a* of the patterns pBk71, pY71, pM1 and pC71 are detected. Consequently, the supply voltage can be changed (adjusted) based on the densities pBk71*a*, pY71*a*, pM71*a* and pC71*a* when the toner 14, as a developer, is overly charged while the printing operation continues to be performed for a long period.

Accordingly, the tone is higher, and the image quality is improved.

Since the O.D. value is read based on the density detecting pattern, and the supply voltage is made the optimum value based on the O.D. value, the densities pBk71*a*, pY71*a*, pM71*a* and pC71*a* can be stabilized. As a result, the tone is higher and the image quality is improved.

Next, the flow diagrams are explained referring to FIGS. 6 and 7. At S21, power is tuned on. At S22, the density detecting pattern is formed. At S23, the density sensor 28 detects the densities pBk100*a*, pY100*a*, pM100*a*, pC100*a*, pBk70*a*, pY70*a*, pM70*a* and pC70*a*. At S24, the densities pBk100*a*, pY100*a*, pM100*a*, pC100*a*, pBk70*a*, pY70*a*, pM70*a* and pC70*a* are recorded in the RAM 42*b*. At S25, the processing judges whether or not the O.D. value is equal to or less than 1.0. When the O.D. value is equal to or less than 1.0 (Yes), the processing proceeds to S29. When the O.D. value is greater than 1.0 (No), the processing proceeds to S26. At S26, the supply voltage correction value is calculated. At S27, the supply voltage is changed, and returns to S22. At S28, the optimum value of the developing voltage is calculated. At S29, the developing voltage is changed. At S30, the processing judges whether or not the count value exceeds 500. When the count value exceeds 500 (Yes), the processing proceeds to S31, and when the count value is equal to or less than 500 (No), the processing proceeds to S38. At S31, the density detecting pattern is formed. At S32, the density sensor 28 detects the densities pBk71*a*, pY71*a*, pM71*a* and pC71*a*. At S33, the densities pBk71*a*, pY71*a*, pM71*a* and pC71*a* are recorded in RAM 42*b*. At S34, the processing judges whether or not the O.D. value is equal to or less than 0.1. When the O.D. value is equal to or less than 1.0 (Yes), the processing proceeds to S37, and when the O.D. value is greater than 0.1 (No), the processing proceeds to S35. At S35, the optimum value of the supply voltage is calculated. At S36, the supply voltage is changed. At S37, the count value is cleared. At S38, the print processing is performed, and then the processing proceeds to the end.

According to each of the embodiments, the tandem type printer that directly transfers a toner image on the sheet P is employed. However, the present application can be applied to an intermediate transferring method printer.

According to each of the embodiments, the color printer is explained as the embodiments. However, the present application can be applied to a copy machine, facsimile machine, multifunction machine or the like.

Moreover, the present application is not limited to each of the aforementioned embodiments, and can be modified, and should not limit the scope of the present application.

What is claimed is:

1. An image forming device, comprising:

an image carrier;

an exposure device that forms a latent image on a surface of the image carrier;

a developer carrier that develops the latent image and forms a developer image by attaching developer on the image carrier;

a developer supplying member that supplies the developer to the developer carrier;

a transferring member that transfers the developer image on a medium;

a pattern forming processing part that forms a first density detecting pattern with a duty of a high tone and a second density detecting pattern with a duty of a middle tone on a pattern forming medium;

a density detection processing part that detects densities of the first density detecting pattern and the second density detecting pattern on the pattern forming medium;

a supply voltage changing processing part that changes a supply voltage that is applied to the developer supplying member based on the detected density of the second density detecting pattern by the density detection processing part; and a developing voltage changing processing part that changes a developing voltage that is applied to the developer carrier based on the detected density of the first density detecting pattern by the density detection processing part after the supply voltage is changed by the supply voltage changing processing part and when the formed density of the second density detecting pattern by the pattern forming processing part is equal to or less than a threshold value.

2. The image forming device of claim 1, wherein the second density detecting pattern is formed with a predetermined duty of 30%~80%.

3. The image forming device of claim 2, wherein the supply voltage is not changed when the detected density of the second density detecting pattern is within a first density range, the supply voltage is corrected by a first change voltage when the detected density of the second density detecting pattern is within a second density range, which is higher than the first density range, the supply voltage is corrected by a second change voltage, which is greater than the first change voltage, when the detected density of the second density detecting pattern is within a third density range, which is higher than the first density range.

4. The image forming device of claim 3, wherein:

the first density range is defined such that when an O.D. value of a detected density is equal to or less than 1.0, the detected density lies within the first density range;

the second density range is that the O.D. value is defined such that when an O.D. value of a detected density is greater than 1.0 and less than 1.3, the detected density lies within the second density range; and the third density range is defined such that when an O.D. value of a detected density is equal to or greater than 1.3, the detected density lies within the third density range.

5. The image forming device of claim 3, wherein the image carrier includes a first image carrier, which carries a first latent image, and a second image carrier, which carries a second latent image, the exposure device includes a first exposure device, which exposes the first-image carrier to form the first latent image, and a second exposure device, which exposes the second image carrier to form the second latent image, the developer carrier includes a first developer carrier, which develops the first latent image with a developer of a first color to form a first developer image, and a second developer carrier, which develops the second latent image with a developer of a second color to form a second developer image, the transferring member includes a first transferring member, which transfers the first developer image, and a second transferring member, which transfers the second developer image, the first image carrier is positioned at an upstream side of the second image carrier with respect to a medium carrying direction, and the first density detecting pattern is formed with the first developer image and the second developer image having the duty of the high tone, the second density detecting pattern is formed with the first developer image and the second developer image having the duty of the middle tone.

6. The image forming device of claim 5, wherein the pattern forming medium is a transferring belt that transfers sheets, the first density detecting pattern and the second density detecting pattern are formed on the transferring belt.

7. The image forming device of claim 6, wherein the first color is black and the second color is any color other than black.

8. The image forming device of claim 1, wherein when the image forming device prints a number of sheets that is not less than a predetermined number, the pattern forming processing part forms the second density detecting pattern on the pattern forming medium, the density detecting processing part detects the density of the second density detecting pattern, and the supply voltage change processing part changes the supply voltage based on the density of the second density detecting pattern.

9. The image forming device of claim 1, wherein the pattern forming medium is a transferring belt that transfers sheets, the second density detecting pattern is formed on the transferring belt between two of the sheets adjoining each other when the image forming device prints more than a predetermined number of the sheets.

10. An image forming method comprising:

forming a latent image on a surface of an image carrier;

developing the latent image and forming a developer image by attaching developer on the image carrier;

supplying the developer to a developer carrier with a developer supplying member;

transferring the developer image to a sheet, which is carried by a transferring unit;

forming a first density detecting pattern with a duty of a high tone and a second density detecting pattern with a duty of a middle tone on a surface of the transferring unit;

detecting densities of the first density detecting pattern and the second density detecting pattern;

changing a supply voltage that is applied to the developer supplying member based on the detected density of the second density detecting pattern; wherein after the changing the supply voltage, another first density detecting pattern with a duty of a high tone and another second density detecting pattern with a duty of a middle tone are formed;

then, densities of the another first density detecting pattern and the another second density detecting pattern are detected;

then, a developing voltage that is applied to the developer carrier is changed based on the detected density of the another first density detecting pattern when the density of the another second density detecting pattern is equal to or less than a threshold value.

11. The image forming method of claim 10, wherein the method includes forming the second density detecting pattern after images have been formed on a predetermined number of sheets.

12. The image forming method of claim 10, wherein the method includes forming the second density detecting pattern between adjacent sheets after images have been formed on a predetermined number of sheets.

13. The image forming method of claim 10 wherein the density of the second detecting pattern is relatively sensitive to environmental conditions.

14. The image forming method of claim 13, wherein the second density detecting pattern is formed with a predetermined duty of 30%~80%.

* * * * *